US007537055B2

(12) United States Patent
Head et al.

(10) Patent No.: US 7,537,055 B2
(45) Date of Patent: May 26, 2009

(54) METHOD AND APPARATUS FOR FORMING A WINDOW IN A CASING USING A BIASING ARM

(75) Inventors: Philip Head, Virginia Water (GB); Paul Lurie, East Horsley (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 18 days.

(21) Appl. No.: 10/534,936

(22) PCT Filed: Nov. 5, 2003

(86) PCT No.: PCT/GB03/04785

§ 371 (c)(1), (2), (4) Date: May 31, 2006

(87) PCT Pub. No.: WO2004/046499

PCT Pub. Date: Jun. 3, 2004

(65) Prior Publication Data

US 2006/0231258 A1 Oct. 19, 2006

(30) Foreign Application Priority Data

Nov. 15, 2002 (GB) ..... 0226725.0

(51) Int. Cl.
*E21B 43/11* (2006.01)
*E21B 23/00* (2006.01)

(52) U.S. Cl. ..... 166/298; 166/55; 166/55.7; 166/117.6

(58) Field of Classification Search ..... 166/55, 166/55.3, 55.7, 117.6, 298
See application file for complete search history.

(56) References Cited

U.S. PATENT DOCUMENTS 2,216,963 A * 10/1940 Sinclair ..... 166/55.3
2,859,943 A 1/1958 Chadderon (Continued)

FOREIGN PATENT DOCUMENTS

GB 1091030 11/1967

(Continued)

OTHER PUBLICATIONS

Database WPI Section Ch, Week 197913—SU 605934A—Apr. 20, 1978—Abstract Figure 1.

*Primary Examiner*—William P Neuder
*Assistant Examiner*—Nicole Coy
(74) *Attorney, Agent, or Firm*—Jaime Castano

(57) ABSTRACT

A method of cutting through a tubular, in particular, a casing at a selected location in a wellbore using a remotely controlled electrically powered cutting tool that comprises (a) a tool body, (b) a cutting head provided with a cutting means, the cutting head pivotally mounted on the tool body at or near the lower end thereof, and (c) an electrically actuatable means for pivoting the cutting head with respect to the tool body, the method comprising the steps of: passing the cutting tool to the selected location in the wellbore with the longitudinal axis of the cutting head aligned with the longitudinal axis of the tool body; pivoting the cutting head with respect to the tool body to a position where the cutting means of the cutting head is adjacent the wall of the tubular; and actuating the cutting means to cut through the tubular of the wellbore.

23 Claims, 3 Drawing Sheets

U.S. PATENT DOCUMENTS

Figure 1A:
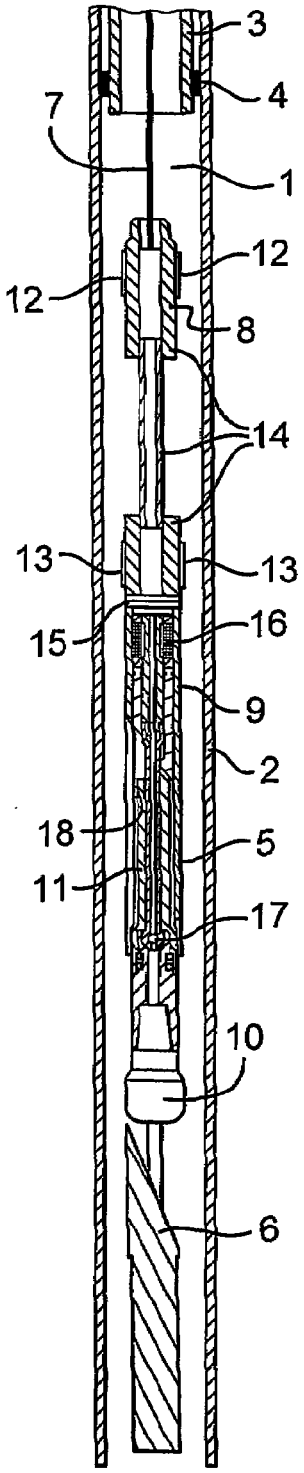

| | | | | |
|---|---|---|---|---|
| 3,195,636 | A | 7/1965 | Cordary et al. | |
| 3,225,828 | A | 12/1965 | Wisenbaker et al. | |
| 3,331,439 | A | 7/1967 | Sanford | |
| 4,809,775 | A | 3/1989 | Fortin | |
| 4,889,187 | A * | 12/1989 | Terrell et al. | 166/298 |
| 6,454,007 | B1 * | 9/2002 | Bailey | 166/298 |
| 6,474,415 | B1 | 11/2002 | Ohmer | |
| 2001/0045282 | A1 * | 11/2001 | Robinson | 166/298 |
| 2002/0007969 | A1 * | 1/2002 | Head et al. | 175/61 |

FOREIGN PATENT DOCUMENTS

| | | |
|---|---|---|
| WO | WO9604457 | 2/1996 |
| WO | WO9964715 | 12/1999 |

* cited by examiner

METHOD AND APPARATUS FOR FORMING A WINDOW IN A CASING USING A BIASING ARM

The present invention relates to a method of forming a window in a tubular of a wellbore, in particular, the casing of a wellbore, using a remotely controlled electrically powered cutting tool.

Where it is desired to drill a side-track or lateral well from a selected location in a cased wellbore, it is necessary to form a window in the casing before commencing drilling of the side-track or lateral well. A window is conventionally formed in the casing of a wellbore by using a whipstock to deflect a milling tool at a slight angle relative to the longitudinal axis of the wellbore so that the milling tool engages with the casing of the wellbore.

U.S. Pat. No. 2,859,943 relates to an expansible well casing milling tool having milling cutters that are moveable between a retracted inoperative position within the tool body and an extended milling position wherein circulation of drilling fluid is utilized to maintain a hydraulic force available to hold the milling cutters in their extended position. The well casing milling tool includes a tubular upper member having internal screw threads at its upper end for connection to a drill string. It is evident that the extended milling cutters rotate about the centre of axis of the tubular upper member such that when the centre of axis of the tubular upper member is aligned with the centre of axis of the wellbore, the milling cutters will remove a section of casing. Further hydraulically actuated cutting and milling tools are described in U.S. Pat. No. 3,195,636, U.S. Pat. No. 3,331,439, and EP 02466864. These milling and cutting tools similarly rely on outward movement of cutting arms from a retracted to an expanded milling or cutting position.

Accordingly, there remains a need for an improved method and an improved tool for forming a window in the casing of a wellbore.

Thus, according to a first embodiment of the present invention there is provided a method of cutting through a tubular of a wellbore at a selected location in the wellbore using a remotely controlled electrically powered cutting tool that comprises (a) a tool body, (b) a cutting head provided with a cutting means, the cutting head being pivotally mounted on the tool body at or near the lower end thereof, and (c) an electrically actuatable means for pivoting the cutting head, the method comprising the steps of: passing the cutting tool to the selected location in the wellbore with the longitudinal axis of the cutting head aligned with the longitudinal axis of the tool body; electrically actuating the pivoting means to pivot the cutting head with respect to the tool body to a position where the cutting means of the cutting head is adjacent the wall of the tubular; and actuating the cutting means to cut through the tubular of the wellbore.

According to a second embodiment of the present invention there is provided a remotely controlled electrically powered cutting tool for cutting through a tubular at a selected location in a wellbore, the tool comprising a tool body and a cutting head provided with a cutting means characterized in that the cutting head is pivotally mounted on the tool body at or near the lower end thereof, and the cutting tool further comprises an electrically actuatable pivoting means for pivoting the cutting head with respect to the tool body from a first position where the longitudinal axis of the cutting head is aligned with the longitudinal axis of the tool body to a second position where the cutting means of the cutting head is adjacent the wall of the tubular.

Thus, pivoting the cutting head causes the cutting means to move in a lateral direction (for example, radially outwardly) with respect to the longitudinal axis of the tool body to a position where the cutting means is adjacent the wall of the tubular.

An advantage of the cutting tool of the present invention is that it is electrically powered. A further advantage of the cutting tool is that it may be deployed on a wireline as opposed to a drill string.

The method and tool of the present invention are used for cutting through a tubular of the wellbore. Suitable tubulars include production tubing and the casing or liner of a wellbore. Typically, a casing may be run from the surface to the bottom of a wellbore. Alternatively, the casing may be run from the surface into an upper section of the wellbore. The lower section of the wellbore may comprise a barefoot or open-hole completion or may be provided with a liner that is hung from the casing that is run into the upper section of wellbore. A casing may also be run from the surface into a previously cased wellbore such that at least a section of the wellbore is provided with a first and a second concentrically arranged casing (hereinafter "double" casing). Optionally, further casing(s) may be run from the surface into the "double" cased wellbore. For avoidance of doubt, the cutting tool is capable of cutting through such "double" and "multiple" casings.

Preferably, a hydrocarbon fluid production tubing is arranged in the wellbore in sealing relationship with the wall of the casing. Preferably, the inner diameter of the casing of the wellbore is in the range 5 to 15 inches. Preferably, the production tubing has an inner diameter of 2.5 to 8 inches, more preferably 3.5 to 6 inches.

Preferably, the tool body is tubular. Preferably, the cutting head is also tubular. Typically, the outer diameter of the tool body and the outer diameter of the cutting head are less than the inner diameter of the production tubing thereby allowing the cutting tool to pass through the production tubing to the selected location in the wellbore. Preferably, the tool body and the cutting head have an outer diameter of 2 to 5 inches.

The cutting tool may be passed to the selected location in the wellbore suspended from a cable, preferably a reinforced steel cable. Alternatively, the cutting tool may be suspended from coiled tubing, for example, drill tubing or from an electric drill string. A suitable electric drill string for use in the method of the present invention is described in UK patent application number 0115524.1 which is herein incorporated by reference.

Where the cutting tool is suspended from a cable, it is preferred that the cable encases one or more wires and/or segmented conductors for transmitting electricity or electrical signals to the cutting tool. The cable may be provided with a plurality of wires or a multiplexed wire. Suitably, the cable may also encase one or more fibre optics for carrying signals, for example, imaging signals such as optical, infra-red, ultraviolet or ultrasonic signals from at least one sensor located on the cutting tool. Alternatively, the cutting tool may be provided with a separate electric cable comprising one or more wires and/or segmented conductors for transmitting electricity or electrical signals and optionally one or more fibre optics.

Where the cutting tool is suspended from coiled tubing, the cutting tool may be provided with an electric cable that passes from the surface to the cutting tool through the interior of the coiled tubing. Suitably, the cable may comprise one or more wires for transmitting electricity or electrical signals and optionally one or more fibre optics.

Where the cutting tool is suspended from an electric drill string, an electrical path is provided between the cutting tool and the surface as described in UK patent application number 0115524.1. It is also envisaged that the electric drill string may be provided with fibre optics for transmitting data to the surface from sensors located on the cutting tool.

Preferably, a connector for the cable, coiled tubing or electric drill string is provided at the upper end of the tool body. Preferably, the connector is releasable from the cable, coiled tubing or electric drill string.

Preferably, the cutting tool is provided with an anchoring means for locking the cutting tool in place in the wellbore. Suitably, the anchoring means is provided at or near the upper end of the cutting tool, for example, on the tool body or the connector. Preferably, an electrically operated stepper motor is located at or near the upper end of the tool body at a position below the anchoring means. After setting the anchoring means, the stepper motor may be operated to rotate the tool body about its longitudinal axis while the cable, coiled tubing or electric drill string remains stationary thereby allowing the cutting head to be orientated in the wellbore. It is also envisaged that the stepper motor may be used to move the pivoted cutting head around the circumference of the tubular such that the cutting means removes a transverse section of the tubular (for example, a transverse section of casing).

Suitably, the tool body of the cutting tool is provided with a transversely extending fulcrum which pivotally supports the cutting head. Preferably, the transversely extending fulcrum of the tool body is a hinge pin, knuckle joint or a universal joint. The hinge pin, knuckle joint or universal joint allows the cutting head to pivot about an axis that is transverse to the longitudinal axis of the tool body so that the cutting means of the cutting head moves into a position adjacent the wall of the tubular. Suitably, the electrically actuatable pivoting means pivots the cutting head about the transversely extending fulcrum. Preferably, this pivoting means is positioned within the tool body.

The term "cutting" as used herein includes milling, ablating and eroding. Thus, the cutting means provided on the cutting head is suitably a mill cutter, an ablation means or an erosion means. Suitably, the cutting means is either electrically powered or electrically actuated. Where the cutting means is a mill cutter, rotation of the pivoted mill head causes the mill cutter to mill through the tubular. Suitably, the tool body is provided with an electric motor for driving a means for rotating the mill head. Where the cutting means is an ablation means and the tubular is formed from metal, the ablation means may be a laser, a means for producing an electric arc or electric spark or any other means for melting or vaporizing metal. Where the cutting means is an erosion means, the erosion means may be a corrosive chemical contained in a receptacle located within the cutting tool (for example, the tool body and/or the cutting head) wherein the receptacle is in fluid communication with an outlet in the cutting head and the outlet is provided with an electrically actuated valve. Once the valve has been actuated, the corrosive chemical may be squeezed out of the receptacle or jetted onto the tubular. Thus, the outlet of the receptacle may be provided with a nozzle for atomizing the corrosive chemical so that an atomized jet of the corrosive chemical is directed at the tubular. Alternatively, the cutting head may be provided with an explosive charge, preferably, a plurality of explosive charges. Suitably, the explosive charge is contained in a receptacle that is comprised of metal. Activation of the explosive charge results in a pressure pulse and/or vaporized metal (arising from the receptacle) that is directed at the tubular thereby cutting through the tubular.

Where the cutting means is a mill cutter or an erosion means, the cutting tool is preferably provided with a biasing means that is actuated to urge the cutting means against the wall of the tubular. Preferably, the biasing means is an elongate arm extending from the upper end of the cutting head with the longitudinal axis of the arm aligned with the longitudinal axis of the cutting head. The elongate arm may be rigidly attached to the cutting head, preferably, at or near the upper end of the cutting head. Alternatively the elongate arm may comprise an integral part of the cutting head. When the cutting head is aligned with the tool body, the elongate arm is preferably retracted into a longitudinal recess in the tool body. As the cutting head pivots about the transversely extending fulcrum of the tool body, the cutting means engages with the wall of the tubular and the free end of the arm simultaneously pivots outwardly from the longitudinal recess in the tool body to engage with the wall of the tubular at a position opposite to the cutting means. Preferably, a traction means, for example, a wheel or roller is provided at the free end of the elongate arm to allow the arm to move over the wall of the tubular.

Where the cutting means functions by melting or vaporizing metal (for example, is a laser or a means for producing an electric spark or arc) the cutting bead pivots about the transversely extending fulcrum of the tool body until the cutting means is in close proximity with the wall of the tubular. Suitably, a biasing means is omitted from the cutting tool as there is no requirement to urge the cutting means against the wall of the tubular.

The operation of the cutting tool will now be described with reference to cutting through the casing of a wellbore. However, as described above, the cutting tool may also be used to cut through the liner of a wellbore, a hydrocarbon fluid production tubing or any other tubular goods that are positioned within the wellbore.

Preferably, the cutting tool is provided with a traction means thereby allowing the cutting tool to be moved in a longitudinal direction through the wellbore to form a window in the casing. Preferably, the window that is formed in the casing of the wellbore has a width of 3 to 9 inches and a length of 10 to 20 feet. Where the longitudinal axis of the wellbore is substantially vertical, the traction means may allow the cutting tool to move in either an upwards or downwards direction in the wellbore, preferably in an upwards direction.

Preferably, the connector for the cutting tool comprises an elongate telescopic part comprising at least one section of tube that is capable of sliding into another section of tube. Suitably, the telescopic movement of the sections of tube is electrically driven. Preferably, an upper and a lower anchoring means are arranged on the connector above and below the telescopic part respectively. Preferably, each anchoring means comprises a set of radially extendible rams, for example, hydraulic rams or electrically operated rams. Preferably, each set of rams comprises 2 to 4, preferably, 3 radially extendible rams that are spaced apart around the connector.

The cutting tool may be lowered into the wellbore with the telescopic part of the connector in its extended state. Once the cutting tool is at the selected location in the wellbore, the upper anchoring means on the connector may be set and the stepper motor used to orientate the cutting head in the wellbore. The cutting head is then pivoted with respect to the tool body so that the cutting means of the cutting head moves to a position adjacent the wall of the casing. The cutting head may then be moved upwardly in the wellbore by gradually driving the telescopic sections of the connector together, setting the lower anchoring means, releasing the upper anchoring means, extending the telescopic part, resetting the upper anchoring means and releasing the lower anchoring means.

This procedure may be repeated several times until the window in the casing is of the desired length, for example, 10-20 feet.

Alternatively, the cutting tool may be lowered into the wellbore with the telescopic part of the connector in its contracted state. Once the cutting tool is at the selected location in the wellbore, the lower anchoring means may be set and the stepper motor used to rotate the cutting tool such that the cutting means on the cutting head is correctly orientated in the wellbore. The cutting head is then pivoted with respect to the tool body such that the cutting means of the cutting head is moved to a position adjacent the wall of the casing. The cutting head may then be moved upwardly in the wellbore by extending the telescopic sections of the connector, setting the upper anchoring means, releasing the lower anchoring means and gradually driving the telescopic sections of the connector together. The lower anchoring means may then be reset, and the procedure may be repeated several times until the window in the casing is of the desired length, for example, 10-20 feet.

Suitably, sensor(s) are provided on the cutting tool for monitoring, amongst other parameters, cutting diagnostics and/or diagnostics associated with movement of the traction means (hereinafter "tractor diagnostics"). The rate of cutting through the casing and the rate at which the tool is moved through the wellbore may be adjusted in response to changes in the cutting diagnostics and tractor diagnostics respectively. Preferably, the cutting rate and the rate of movement of the cutting tool through the wellbore is automatically adjusted in response to changes in these diagnostics.

Preferably, a guide means is suspended from the cutting tool, for example, by a releasable latch means. Preferably, the guide means is a whipstock. By whipstock is meant a tool having a plane surface inclined at an angle relative to the longitudinal axis of the wellbore. Suitably, the guide means may be locked in place in the wellbore via at least one radially extendible gripping member, for example, radially extendible arms that are capable of engaging with the walls of the casing. Suitably, the guide means, with its gripping member(s) in its non-extended state, has a maximum diameter smaller than the inner diameter of the production tubing, thereby allowing the cutting tool and attached guide means to pass through the production tubing to the selected location in the wellbore. Once the guide means has emerged from the bottom of the production tubing and is positioned immediately below the selected location in the wellbore where it is desired to form the window for the side-track or lateral well, the guide means is orientated in the wellbore using the stepper motor and is locked into place in the casing via the radially extendible gripping member(s). The guide means in then released from the cutting tool.

Following completion of the cutting operation, the cutting tool is lowered down the wellbore to reattach the guide means thereto. The radially extendible gripping member(s) on the guide means is then retracted and the cable, coiled tubing or electric drill string may be pulled from the wellbore until the guide means is aligned with the window in the casing. Alternatively, the traction means of the cutting tool may be operated until the guide means is aligned with the window in the casing. The guide means is then locked in place in the wellbore via the radially extendible gripping member(s), for example, radially extendible arms before being disconnected from the cutting tool. The cutting tool may then retrieved from the wellbore by pulling the cable, coiled tubing or electric drill string. It is also envisaged that the cutting tool may be retrieved from the wellbore using its traction means.

Following the retrieval of the cutting tool, a drilling tool, preferably, an electrically powered drilling tool, may be lowered into the wellbore, through the production tubing, suspended on a cable, coiled tubing or an electric drill string until the drilling tool encounters the guide means. The guide means then causes the drilling tool to deflect from the original trajectory of the wellbore into the window formed in the casing such that operation of the drilling tool results in the drilling of a side-track or lateral well. Where the guide means is provided with a fluid by-pass, the guide means may remain in the wellbore following completion of drilling of the side-track or lateral well. The fluid by-pass allows produced fluid from the original wellbore to continue to flow to the surface through the production tubing. Preferably, the guide means is collapsible, for example, has retractable parts and is capable of being retrieved through the hydrocarbon fluid production tubing when in its collapsed state, for example, by lowering a cable having a latch means located at the lower end thereof into the wellbore through the production tubing, connecting the guide means to the cable via the latch means and pulling the cable from the wellbore.

According to a preferred aspect of the present invention there is provided a method of milling through a casing of a wellbore at a selected location in the wellbore using a remotely controlled electrically powered milling tool comprising (a) a tool body, (b) a rotatable mill head provided with a mill cutter, the mill head being pivotally mounted on the tool body at or near the lower end thereof, (c) an electrically actuatable pivoting means for pivoting the mill head, and (d) a biasing means, the method comprising the steps of:

passing the milling tool to the selected location in the wellbore with the longitudinal axis of the mill head aligned with the longitudinal axis of the tool body;

electrically actuating the pivoting means to pivot the mill head with respect to the tool body to a position where the mill cutter on the mill head engages with the wall of the casing;

actuating the biasing means to urge the mill cutter against the wall of the casing; and rotating the mill head so that the mill cutter mills through the casing.

According to a further preferred aspect of the present invention there is provided a remotely controlled electrically powered milling tool for milling through a casing at a selected location in a wellbore, the tool comprising a tool body and a rotatable mill head provided with a mill cutter characterized in that the mill head is pivotally mounted on the tool body at or near the lower end thereof and the milling tool further comprises (a) an electrically actuatable pivoting means for pivoting the mill head with respect to the tool body from a first position where the longitudinal axis of the mill head is aligned with the longitudinal axis of the tool body to a second position where the mill cutter engages with the wall of the casing, and (b) a biasing means for urging the mill cutter against the wall of the casing.

Thus, pivoting the mill head causes the mill cutter to move in a lateral direction (for example, radially outwardly) with respect to the longitudinal axis of the tool body to a position where the mill cutter is adjacent the wall of the tubular.

Preferably, the tool body is provided with a transversely extending fulcrum on which the mill head is pivotally mounted such that the mill head pivots about an axis that is transverse to the longitudinal axis of the tool body to a position where the mill cutter engages with the wall of the casing.

An advantage of these preferred aspects of the present invention is that the mill cutter rotates about the centre of axis of the pivoted head to remove a window in the casing whereas in the prior art tools the mill cutter rotates about the centre of axis of the tool body.

Preferably, the milling tool is provided with a traction means for moving the milling tool in a longitudinal direction through the wellbore. A preferred traction means comprises a telescopic connector provided with upper and lower anchoring means, as described above. A further advantage of the traction means is that this takes up the reactive torque of the mill head.

Preferably, the milling tool is orientated in the wellbore using a stepper motor located at or near the top of the tool body. The stepper motor also allows the mill cutter to remove a transverse section of the casing.

Suitably, the biasing means is a biasing arm, as detailed above.

Preferably, the tool body is tubular. Preferably, the pivoting means for pivoting the mill head is located within the tool body.

Preferably, the mill head is substantially tubular with the mill cutter located at the base of the mill head. Where the milling tool is to be used for milling a window in a metal casing, the mill cutter should be capable of milling through the casing by grinding or cutting the metal.

Preferably, the milling tool is passed to the selected location in the wellbore suspended on a cable, coiled tubing or an electric drill string as detailed above. Suitably, the outer diameter of the mill head is less than the inner diameter of the production tubing. However, it is envisaged that the mill head may be provided with an expandable mill cutter wherein the mill cutter in its expanded state has a diameter greater than the inner diameter of the production tubing but less than the inner diameter of the casing thereby providing sufficient clearance for the mill head to pivot with respect to the tool body.

Preferably, the tool body of the milling tool is provided with a remotely controlled electrically powered motor for rotating the mill head. Suitably, the motor for driving the mill head has a power of 1 to 50 kw, preferably 1 to 10 kw.

Preferably, the milling tool is provided with sensors for monitoring mill diagnostics such as forces acting on the mill head, the applied torque, and the temperature of the cutting surfaces of the mill cutter. Sensors may also be provided for motor diagnostics and tractor diagnostics. Suitably, the data from the sensors is transmitted to the surface via fibre optics, as described above. Suitably, the rate of milling and the rate of movement of the milling tool through the wellbore is adjusted, preferably automatically, in response to changes in these diagnostics.

The present invention will now be illustrated with the aid of the following figures.

Referring to FIG. 1*a*, a wellbore 1 has a metal casing 2 fixed to the wellbore wall by a layer of cement (not shown). A hydrocarbon fluid production tubing 3 is positioned within the wellbore 1 and a packer 4 is provided at the lower end thereof to seal the annular space formed between the tubing 3 and the casing 2. A remotely controlled electrically powered milling tool 5 having a guide means 6, for example, a whipstock, attached to the lower end thereof via a releasable latch means (not shown) is passed into the wellbore 1 through the hydrocarbon fluid production tubing 3 suspended on a reinforced steel cable 7 comprising at least one electric conductor wire (not shown). The milling tool 5 comprises a connector 8 for the cable 7, a tubular tool body 9, a mill head 10 having a mill cutter (not shown) and an elongate biasing arm 11 connected to the upper end of the mill head 10. The connector 8 is provided with an upper set of rams 12 and a lower set of rams 13, positioned above and below telescopic sections 14 of the connector. An electrically operated stepper motor 15 is located at or near the top of the tubular tool body 9 thereby allowing the tubular tool body 9 and mill head 10 to be rotated about the longitudinal axis of the wellbore, with the connector 8 and cable remaining stationary. The tubular tool body 9 is provided with an electrically powered motor 16 arranged to drive the mill head 10. The mill head 10 is supported from a transversely extending fulcrum 17, for example, a hinge pin, knuckle joint or universal joint located at the lower end of the tubular tool body 9. The milling tool 5 is lowered into the wellbore 1 through the production tubing 3 with the longitudinal axis of the mill head 10 aligned with the longitudinal axis of the tubular tool body 9 and the elongate biasing arm 11 retracted into a recess in the tubular tool body 9. The arm 11 is provided with a traction means 18, for example, a wheel or roller.

Figure 1B:
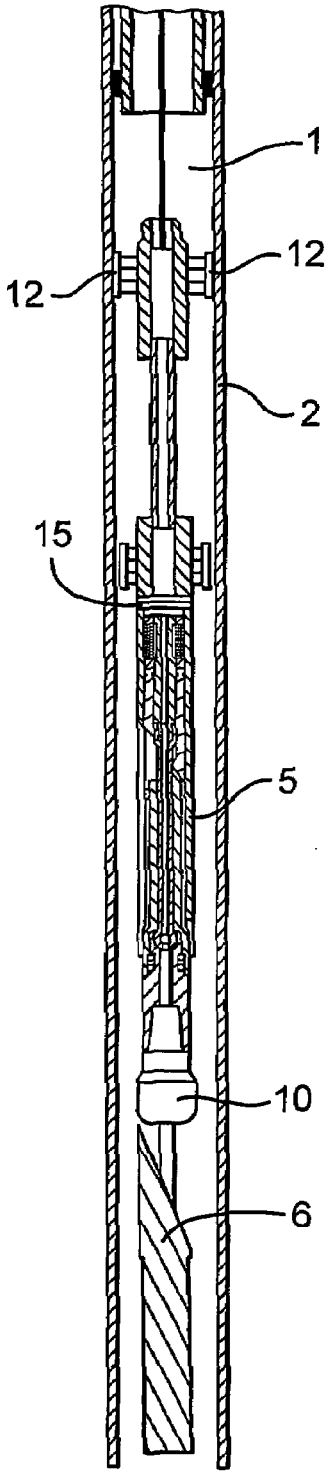

Referring to FIG. 1*b*, the milling tool 5 is locked in place in the wellbore 1 at the selected location via the upper set of rams 12 with each ram extending radially outwards to engage with the wall of the casing 2. The stepper motor 15 is then used to correctly orientate the mill head 10 and guide means 6 in the wellbore 1.

Figure 1C:
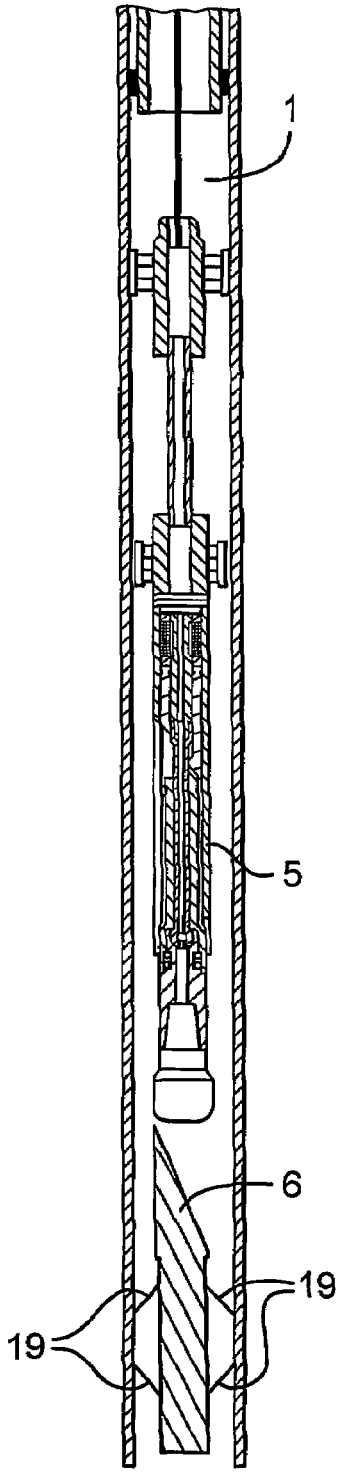

Referring to FIG. 1*c*, the guide means 6 is locked in place in the wellbore 1 via extendible arms 19 before releasing the guide means 6 from the milling tool 5.

Figure 1D:
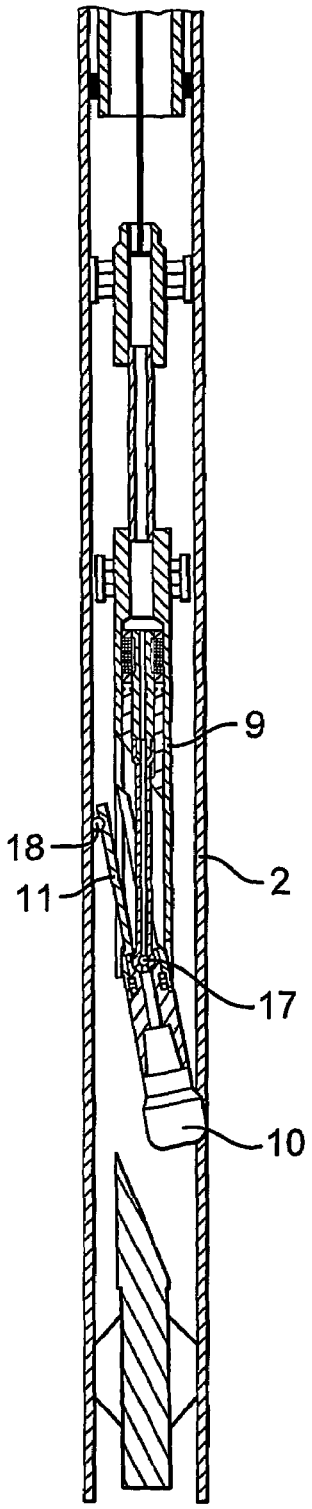

Referring to FIG. 1*d*, the mill head 10 is pivoted about the transversely extending fulcrum 17 of the tubular tool body 9 such that the mill cutter of the mill head 10 engages with the wall of the casing 2 at the position where it is desired to mill the window. Thus, by pivoting the mill head the mill cutter moves in a lateral direction with respect to the longitudinal axis of the tool body. Simultaneously, the elongate biasing arm 11 is pivoted outwardly from its longitudinal recess such that the traction means 18 on the elongate biasing arm 11 engages with the wall of the casing 2 at a location opposite the mill head 10. The means for pivoting the mill head 10 and associated biasing arm 11 about the transversely extending fulcrum 17 is electrically actuated. The mill head 10 is then rotated such that the mill cutter mills through the casing 2 and cement of the wellbore.

Figure 1E:
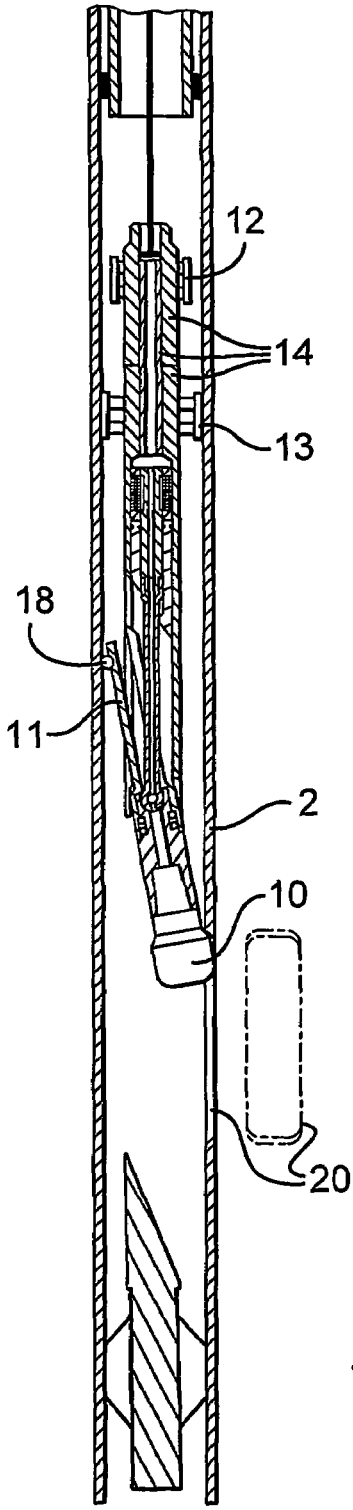

Referring to FIG. 1*e*, a window 20 of the desired size may be milled in the casing by gradually driving the telescopic sections 14 of the connector together thereby causing the biasing arm 11 to move upwardly over the wall of the casing (via the traction means 18) and the mill cutter of the mill head 10 to extend the window in an upwards direction. If necessary, the size of the window 20 may be further increased by engaging the lower set of rams 13 on the connector 8, releasing the upper set of rams 12, extending the telescopic sections 14 of the connector 8, engaging the upper set of rams 12 and releasing the lower set of rams 13. This procedure may be repeated several times until the window 20 is of the desired size.

Figure 1F:
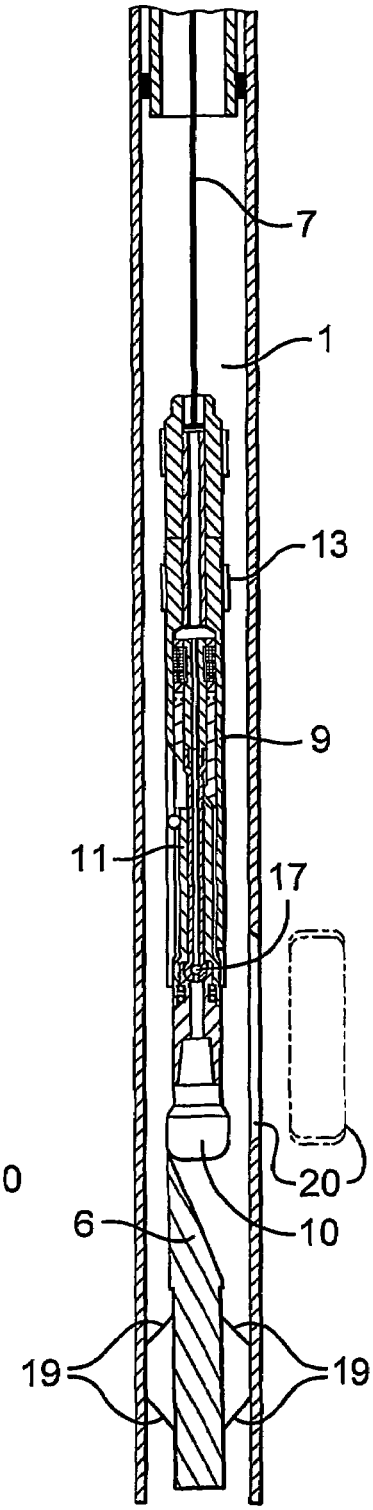

Referring to FIG. 1*f*, after the milling operation has been completed, the mill head 10 is pivoted about the transversely extending fulcrum 17 until the longitudinal axes of the mill head 10 is aligned with the longitudinal axis of the tubular tool body 9 and the associated elongate biasing arm 11 is simultaneously pivoted inwardly until it is returned to its retracted position within the longitudinal recess in the tubular tool body. The lower set of rams 13 is then released and the milling tool is lowered through the wellbore 1 to reattach the guide means 6 to the milling tool. The arms 19 on the guide means 6 are then retracted and the milling tool is moved upwardly in the wellbore until the guide means 6 is aligned with the window 20 milled in the casing 2.

Figure 1G:
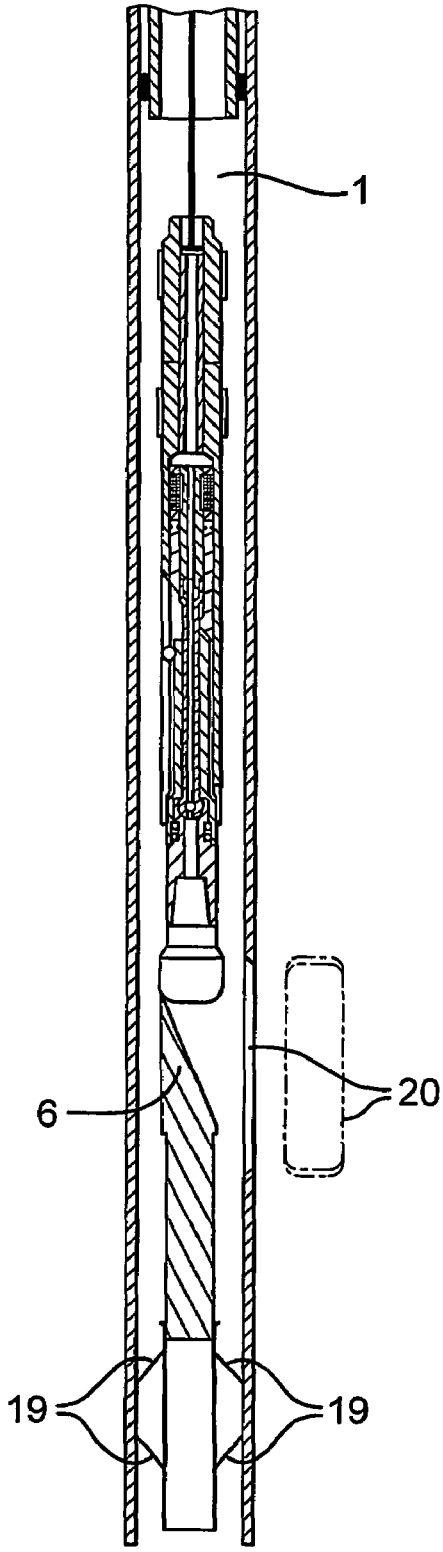

Referring to FIG. 1*g*, the guide means 6 is locked into place in the wellbore 1, adjacent the window 20, via the extendible arms 19 before being detached from the milling tool.

Figure 1H:
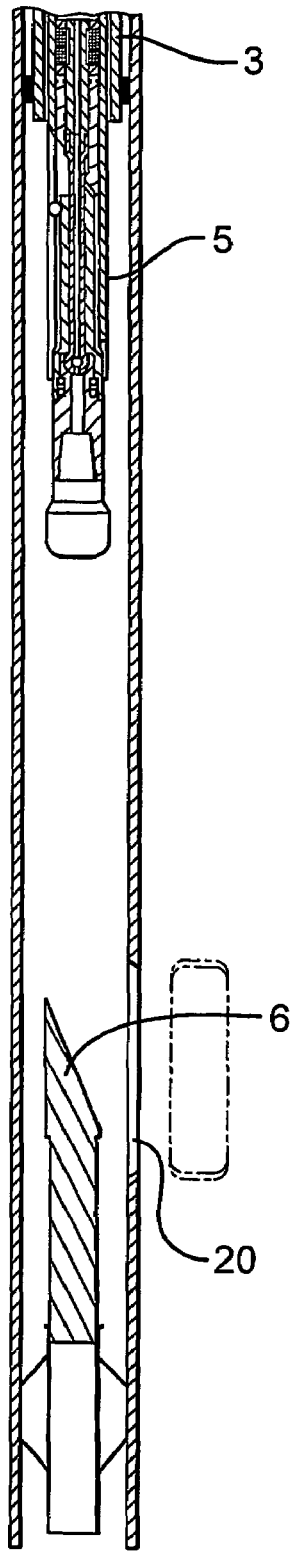

Referring to FIG. 1*h*, the milling tool is retrieved from the wellbore 1 by pulling the cable. A drilling tool may subsequently be run into the wellbore 1 through the production tubing 3. The guide means 6 deflects the drilling tool through the window 20 to drill a side-track or lateral well.

The invention claimed is:

1. A method of cutting through a tubular of a wellbore at a selected location in the wellbore using a remotely controlled electrically powered cutting tool that comprises (a) a tool body, (b) a cutting head provided with a cutting means, the cutting head being a rotatable mill head provided with a mill cutter and is pivotally mounted on the tool body at or near the lower end thereof, (c) an electrically actuatable means for pivoting the cutting head, and (d) a biasing means, the method comprising the steps of:

passing the cutting tool to the selected location in the wellbore with the longitudinal axis of the cutting head aligned with the longitudinal axis of the tool body;

electrically actuating the pivoting means to pivot the cutting head with respect to the tool body to a position where the cutting means of the cutting head is adjacent the wall of the tubular;

actuating the biasing means to urge the cutting means of the cutting head against the wall of the tubular, and actuating the mill cutter and rotating the mill head so that the mill cutter cuts through the tubular of the wellbore, wherein the biasing means is an elongate arm that is an extension of the cutting head, said arm being moveable between a retracted position where said elongate arm lies within a longitudinal recess in the tool body and an extended position.

2. A method as claimed in claim 1 wherein the tool body is provided with a transversely extending fulcrum which pivotally supports the cutting head and the pivoting means pivots the cutting head about the transversely extending fulcrum to a position where the cutting means of the cutting head is adjacent the wall of the tubular.

3. A method as claimed in claims 1 wherein the tubular is a hydrocarbon fluid production tubing, a casing or a liner of a wellbore.

4. A method as claimed in claim 1, wherein the cutting tool is passed to the selected location in the wellbore through the production tubing.

5. A method as claimed in claim 1 wherein the cutting tool is passed to the selected location in the wellbore with the elongate arm in its retracted position and actuation of the means for pivoting the cutting head causes the elongate arm to pivot outwardly with respect to the tool body to its extended position to engage the wall of the tubular at a position opposite to the cutting means.

6. A method as claimed in claim 1 wherein the elongate arm is provided with traction means at the location where the arm engages the wall of the tubular.

7. A method as claimed as claimed in claim 1 wherein the cutting tool is passed to the selected location in the wellbore suspended from a cable, coiled tubing, or an electric drill string via a releasable connector.

8. A method as claimed as claimed in claim 1 wherein the cutting tool further comprises an anchoring means and the tool is locked in place at the selected location in the wellbore by setting the anchoring means prior to actuating the pivoting means.

9. A method as claimed in claim 8 wherein the tool further comprises a stepper motor located below the anchoring means and after setting the anchoring means, the stepper motor is operated to rotate the tool body about its longitudinal axis while the cable, coiled tubing or electric drill string remains stationary thereby allowing the cutting head to be orientated in the wellbore prior to actuating the pivoting means.

10. A method as claimed as claimed in claim 1 wherein the cutting tool further comprises a fraction means for moving the cutting tool in a longitudinal direction through the wellbore and the method further comprises the step of actuating the traction means to longitudinally extend the cut that is made through the tubular.

11. A remotely controlled electrically powered cutting tool for cutting through a tubular at a selected location in a wellbore, the tool comprising (a) a tool body, (b) a cutting head provided with a cutting means, the cutting head being a rotatable mill head provided with a mill cutter and pivotally mounted on the tool body at or near the lower end thereof, (c) an electrically actuatable means for pivoting the cutting head, and (d) a biasing means to urge the cutting means of the cutting head against the wall of the tubular, wherein the biasing means is an elongate arm that is an extension of the cutting head, said arm being moveable between a retracted position where said elongate arm lies within a longitudinal recess in the tool body and an extended position.

12. A tool as claimed in claim 11 wherein the cutting tool is provided with a transversely extending fulcrum on which the cutting head is pivotally mounted.

13. A tool as claimed in claim 11 wherein the tool body is provided with a releasable connector for a cable, coiled tubing or electric drill string.

14. A tool as claimed in claim 11 wherein the cutting tool is provided with an anchoring means for locking the tool in place in a wellbore.

15. A tool as claimed in claim 14 wherein an electrically operated stepper motor is located at or near the upper end of the tool body at a position below the anchoring means.

16. A tool as claimed in claim 11 wherein the tool further comprises a traction means for moving the tool in a longitudinal direction through a wellbore.

17. A tool as claimed in claim 16 wherein the traction means comprises (a) a connector for the cable, coiled tubing or electric drill string having at least one telescopic part comprising a section of tube that is capable of sliding into another section of tube and (b) independently operatable upper and a lower anchoring means arranged on the connector above and below the telescopic part respectively.

18. A tool as claimed in claim 17 wherein the upper and lower anchoring means each comprise a set of radially extendible rams.

19. A tool as claimed in claim 11 wherein a guide means having a radially extendible gripping member is releasably suspended from the tool.

20. A tool as claimed in claim 11 wherein a remotely-controlled electrically powered motor is located within the tool body for rotating the cutting head.

21. A method of cutting through a tubular of a wellbore at a selected location in the wellbore using a remotely controlled electrically powered cutting tool that comprises (a) a tool body, (b) a cutting head provided with a cutting means, the cutting head being pivotally mounted on the tool body at or near the lower end thereof, (c) an electrically actuatable means for pivoting the cutting head, (d) a biasing means, and (e) traction means for moving the cutting tool in a longitudinal direction through the wellbore, the method comprising the steps of:

passing the cutting tool to the selected location in the wellbore with the longitudinal axis of the cutting head aligned with the longitudinal axis of the tool body;

electrically actuating the pivoting means to pivot the cutting head with respect to the tool body to a position where the cutting means of the cutting head is adjacent the wall of the tubular;

actuating the biasing means to urge the cutting means of the cutting head against the wall of the tubular, actuating the cutting means to cut through the tubular of the wellbore, actuating the traction means to longitudinally extend the cut that is made through the tubular, wherein the biasing means is an elongate arm that is an extension of the cutting head, said arm being moveable between a retracted position where said elongate arm lies within a longitudinal recess in the tool body and an extended position.

22. A remotely controlled electrically powered cutting tool for cutting through a tubular at a selected location in a wellbore, the tool comprising (a) a tool body, (b) a cutting head provided with a cutting means, the cutting head being pivotally mounted on the tool body at or near the lower end thereof, (c) an electrically actuatable means for pivoting the cutting head, (d) a biasing means to urge the cutting means of the cutting head against the wall of the tubular, the biasing means being an elongate arm that is an extension of the cutting head, said arm being moveable between a retracted position where said elongate arm lies within a longitudinal recess in the tool body and an extended position, and (e) traction means for moving the tool in a longitudinal direction through a wellbore, the traction means comprising a connector for a cable, coiled tubing or electric drill string having at least one telescopic part comprising a section of tube that is capable of sliding into another section of tube and independently operatable upper and lower anchoring means arranged on the connector above and below the telescopic part respectively.

23. A tool as claimed in claim 22 wherein the upper and lower anchoring means each comprise a set of radially extendible rams.

* * * * *